United States Patent [19]

Gits et al.

[11] 4,052,940

[45] Oct. 11, 1977

[54] METHOD AND ARTICLE OF MANUFACTURE OF A PYROTECHNIC DEVICE

[75] Inventors: Gerald B. Gits, Riverside; Daniel L. Deverich, Lyons, both of Ill.

[73] Assignee: Apollo of the Ozarks, Inc., Stanton, Mo.

[21] Appl. No.: 622,803

[22] Filed: Oct. 16, 1975

[51] Int. Cl.[2] ..... C06D 1/06; C06D 1/08

[52] U.S. Cl. ..... 102/33; 86/20 A

[58] Field of Search ..... 102/33, 37, 31, 32; 86/20 A

[56] References Cited

U.S. PATENT DOCUMENTS

| | | | |
|---|---|---|---|
| 1,253,596 | 1/1918 | Hitt | 102/33 |
| 1,563,379 | 12/1925 | Kohn | 102/33 |
| 1,610,645 | 12/1926 | Adler | 102/33 |
| 1,673,938 | 6/1928 | Fabrizio | 102/33 |
| 1,783,999 | 12/1930 | Cimdrosi | 102/33 |
| 1,789,372 | 1/1931 | Scardone | 102/33 |
| 1,792,246 | 2/1931 | Rutter | 102/33 |
| 2,034,976 | 3/1936 | Decker | 102/33 |
| 2,053,772 | 9/1936 | Fabrizio | 102/37 |

*Primary Examiner*—Samuel W. Engle
*Assistant Examiner*—Donald P. Walsh
*Attorney, Agent, or Firm*—Sughrue, Rothwell, Mion, Zinn and Macpeak

[57] ABSTRACT

A firecracker being constructed of minimal quantities of exothermic composition having maximal audible detonating effect which is achieved through the balanced relationship between burst strength of casing, its sealing of plugs, and the charge, resulting in substantial safety over the known art.

1 Claim, 3 Drawing Figures

FIG. 1
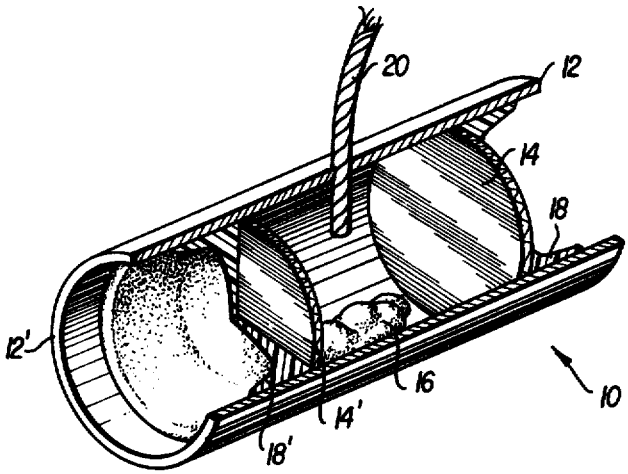
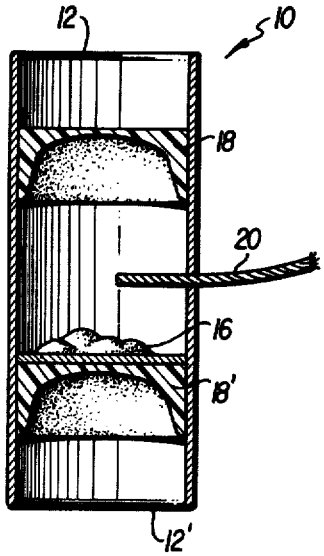
FIG. 2
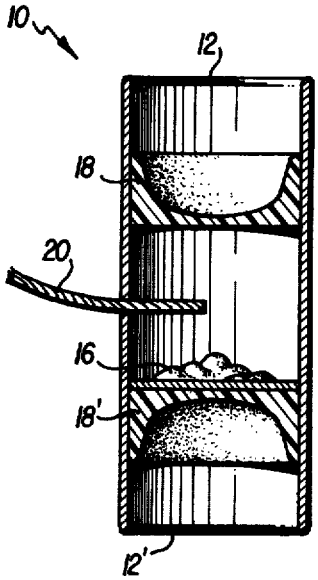
FIG. 3

METHOD AND ARTICLE OF MANUFACTURE OF A PYROTECHNIC DEVICE

DESCRIPTION OF THE PRIOR ART

The type of pyrotechnic device or firecracker which is generally known in the trades as the M-80 and Silver Tube firecracker which contains 15 grains or more of explosive, is 1.5 inches in length, ⅝ inches in diameter and 0.035 inches wall thickness. Most firecrackers or salutes depend upon confining a selected explosive material to create upon ignition the pressure, which in turn accelerates the oxydation reduction process of the explosive to the point of deflagration and detonation. By increasing the strength of the casing per se, one may increase the audible effect but aside from the danger, said effect is generally derived from the detonation of the explosive and secondarily from the burst of the casing, per se. In the prior art, numerous efforts have been made to create a salute in firecracker construction wherein increased detonation may be derived from confining the explosive in a container having all sides of equal strength.

Reference is made in this connection to Cimorosi U.S. Pat. No. 1,783,999; Fabrizio U.S. Pat. No. 1,673,938; Fabrizio U.S. Pat. No. 2,053,772 and Scardoni U.S. Pat. No. 1,789,372. The audible effect in prior art devices is largely due to the detonating of the heavy charge of flash powder and only minimally related to the bursting of the casing per se.

It will be obvious that the extra charge of powder has definite deleterious safety aspects to property and persons using the device. For example, an explosive device containing flash powder charges in excess of 10 grains can by concussion and brissance damage surfaces or objects in its proximity such as parts of the body by contusion, laceration or amputation or by lofting extraneous objects at injurious speeds as trajectories. Additionally, such devices which have flash powder quantities in excess of 10 grains can by sympathetic detonation of their explosive force cause the explosion of others.

In contrast to the prior art, the present firecracker salute does not depend on a heavier charge of explosive and on the burst of a reinforced container, for its audible effect but is effective with seven times less the quantity of explosive, per se. The uniqueness of the invention resides in a balanced relationship between the burst strength of the casing, burst strength of the plug used to seal the end of the casing, and the bursting power of the flash powder which is substantially less than is common in the art. The present invention is directed to the fabrication of a comparatively safe, substantially cylindrical explosive container, sealed at its ends with the explosive generally located centrally thereof, in coactive relationship to the fuse.

BRIEF DESCRIPTION OF THE DRAWING

FIG. 1 is a view in perspective of preferred form of invention, portions thereof being broken away to show the interior construction thereof.

FIGS. 2 and 3 illustrate vertical sectional modifications of invention.

DESCRIPTION OF THE PREFERRED EMBODIMENT

The firecracker or salute 10 is of the general configuration known in the trade as the M-80. This comprises a spiral or convolute wound cylindrical tube having a wall thickness of 0.035 inches but may vary from 0.015 to 0.040 inches, depending upon other conditions hereinafter described. The tube is fabricated of a paper and has an inner diameter of ½ to ⅝ inches with a length of 1 to 1¾ inches. Thus, ideally and for the specific purposes of illustration herein an M-80 paper tube may be constructed of the following dimensions, namely 1½ inches in length; ⅝ inches in side diameter; and having a 0.035 wall thickness. With respect to the inner diameter and length, this may comprise the somewhat smaller size of ½ inch in diameter and 1½ inches in length, generally known in the trade as the Silver Tube Salute size. The casing of the tube comprising ends 12 and 12' include a paper disc 14 which may be either flat or cupped (not shown), the outside diameter thereof being slightly larger than the inside diameter of the tube, said disc being adapted to contain 1.2 to 2 grains of the flash powder charge 16, the entire being contained by a reinforcing fillet 18, described hereinafter. With respect to the disc 14, it may comprise a paper, cardboard or other fibrous lightweight material such as expanded cellular composite or styrofoam. This disc may be of a thickness which is 0.10 to 0.125 inches but more significant is its outer diameter dimension, relative to the inner diameter of the tube, per se. The sealer of the casing may comprise a sodium silicate or water glass, which is thickened with gypsum. As shown, however, it is most important that the sealant be applied in such a manner that it may create a reinforcing fillet behind the paper disc with a substantially extended adherent area adjacent its periphery, relative to the interior wall of the tube. The combined effect hereof is such as to contain the burning powder until maximum burst pressure may be reached. Whereas other sealants such as hot milk glue or caseing glue may be applied, in any event the sealant should be neither too strong nor so dense that a dangerous bursting missile may be created. In general it may comprise a water base, solvent base, hot milk, catalyst hardening or thermo setting material which when hardened provides a frangible reinforcement, seal for the containment of the ignited flash power within the casing, the sealant being applied to 15 to 20% of the longitudinal interior depth of the tube, to provide thereby an adequate but readily frangible grip. The sealant such as sodium silicate must therefore have the quality of fracturing into small and harmless pieces in the process of detonation of the salute.

The fillets 18 and 18' are axially spaced to form a relatively large hollow cavity whose volume is substantially larger than that of the mass of charge 16, the cavity occupying a space approximately one-third the longitudinal interior of the tube.

The fuse may comprise any common pyrotechnic safety fuse of the type which is well known in the art.

From the aforementioned, and with reference to FIG. 1, it will be appreciated that the essence of invention resides in the balanced relationship between the burst strength of the casing and of the composite plug used to seal the ends of the casing as well as the bursting power of the exothermic pyrotechnic composition known as flash powder.

By construction in the following manner, a minimal flash powder charge of 1.2 to 2 grains may create an explosive force which is largely expended in the burst of the casing and its accompanying composite sealing means. In the preferred FIG. 1 configuration shown, there are opposed discs 14 – 14' containing the flash powder with the exothermic pyrotechnic safety fuse leading into the chambers defined by the respective discs through a wall aperture.

Alternate means of construction are depicted in FIGS. 2 and 3 and include forming the respective sealant plugs with no more than one disc as shown in the modifications of FIG. 2. Notably, the sealants 18–18' are prepared with the wall contacting peripheral extensions being unidirectional; whereas in the FIGS. 1 and 3 embodiments they are opposed in orientation. In both FIGS. 2 and 3 the accompanying discs 14 are exposed to the interior alone, lending strength to the selected end of the casing.

I claim

1. A pyrotechnic device having maximal audible effect upon detonation comprising:

a frangible tubular casing, 1–1¾ inches in length by ½ to ⅝ inches inside diameter;

an explosive charge within said casing, said charge being no greater than 2 grains;

a disc within said casing between said charge one open end with said disc and sealant closing off said one open end of said casing and at least a sealant closing off the other end of said casing, said sealants being axially spaced from each other to define a hollow cavity containing said explosive charge whose volume is substantially larger than the volume occupied by the mass of explosive charge with said cavity extending approximately one-third the length of said casing;

said casing being of 0.015 to 0.040 inches in thickness and said disc having a thickness of from 0.010 to 0.125 inches;

a fuse secured within said casing in communication with the explosive; and wherein each of said sealants is in contact with said casing on opposite sides of said explosive charge and constituting a longitudinally extending solid fillet with the periphery of the fillet contacting the interior of the frangible tubular casing over 15% to 20% of the longitudinal interior depth of the casing; wherein the resistance of the casing and the resistance of the sealants is such as to provided a balanced inertial resistance to insure bursting of the casing upon detonation of the explosive charge.

* * * * *